US012692855B2

(12) United States Patent
Braun et al.

(10) Patent No.: US 12,692,855 B2
(45) Date of Patent: Jul. 28, 2026

(54) DIAPHRAGM RUPTURE SIGNALLING DEVICE

(71) Applicant: ProMinent GmbH, Heidelberg (DE)

(72) Inventors: Josef Braun, Hockenheim (DE); Maximilian Göpfert, Mannheim (DE); Manuel Niedermayer, Langenbrücken (DE); Martin Reinhard, Heidelberg (DE); Marc Mohr, Mannheim (DE)

(73) Assignee: ProMinent GmbH, Heidelberg (DE)

( * ) Notice: Subject to any disclaimer, the term of this patent is extended or adjusted under 35 U.S.C. 154(b) by 0 days.

(21) Appl. No.: 18/961,602

(22) Filed: Nov. 27, 2024

(65) Prior Publication Data

US 2025/0172136 A1 May 29, 2025

(30) Foreign Application Priority Data

Nov. 27, 2023 (DE) ..... 102023132946.4

(51) Int. Cl.
*F04B 43/00* (2006.01)
*F04B 43/02* (2006.01)
(Continued)

(52) U.S. Cl.
CPC ..... *F04B 43/0081* (2013.01); *F04B 43/009* (2013.01); *F04B 43/02* (2013.01); *F04B 51/00* (2013.01); *F04B 49/10* (2013.01)

(58) Field of Classification Search
CPC .... F04B 43/0081; F04B 43/009; F04B 43/02; F04B 51/00; F04B 49/10
See application file for complete search history.

(56) References Cited

U.S. PATENT DOCUMENTS 3,131,638 A * 5/1964 Wilson ..... F04B 43/009 417/388
5,074,757 A * 12/1991 Horn ..... F04B 43/009 417/63

(Continued)

FOREIGN PATENT DOCUMENTS

DE 3146222 A1 6/1983
DE 3931516 A1 4/1991

(Continued)

OTHER PUBLICATIONS

Search Report dated Jul. 31, 2024 in German Application No. 102023132946.4.

*Primary Examiner* — Charles G Freay
(74) *Attorney, Agent, or Firm* — SALIWANCHIK, LLOYD & EISENSCHENK

(57) ABSTRACT

In order to provide a diaphragm rupture signalling device for a diaphragm pump, which ensures a more functionally reliable rupture signalling compared to the prior art, a diaphragm to be arranged between the drive unit and the delivery unit is disclosed, with at least a first and a second essentially circular diaphragm layer, wherein the diaphragm has a clamping area and an operating area and a sensor area arranged in the section of the clamping area in which at least one of the diaphragm layers is designed such that, when the pressure between this diaphragm layer and the adjacent diaphragm layer increases, it moves further away from the adjacent diaphragm layer in the section of the sensor area than in the other sections of the diaphragm, with an increase in the distance between the diaphragm layers, thereby triggering a diaphragm rupture signalling signal in the diaphragm pump.

15 Claims, 4 Drawing Sheets

(51) Int. Cl.
*F04B 51/00* (2006.01)
*F04B 49/10* (2006.01)

(56) References Cited

U.S. PATENT DOCUMENTS

| | | | | |
|---|---|---|---|---|
| 6,498,496 | B1 | 12/2002 | Carl | |
| 6,907,816 | B2 * | 6/2005 | Bubb | F04B 43/009 92/5 R |
| 6,941,853 | B2 * | 9/2005 | Hembree | F04B 43/009 92/5 R |
| 7,836,814 | B2 | 11/2010 | Lefebvre | |

FOREIGN PATENT DOCUMENTS

| | | | |
|---|---|---|---|
| DE | 4018464 | A1 | 12/1991 |
| DE | 4327970 | A1 | 3/1995 |
| DE | 10012902 | B4 | 2/2004 |
| DE | 10323059 | A1 | 12/2004 |
| DE | 102008053050 | A1 | 4/2010 |
| DE | 102016001806 | A1 | 8/2017 |
| DE | 102019109283 | A1 | 10/2020 |
| DE | 102021125266 | A1 | 3/2023 |
| EP | 1384891 | B1 | 3/2005 |

* cited by examiner

DIAPHRAGM RUPTURE SIGNALLING DEVICE

CROSS-REFERENCE TO RELATED APPLICATION

This application claims the benefit of German Application No. 102023132946.4, filed Nov. 27, 2023, the disclosure of which is incorporated by reference herein in its entirety.

TECHNICAL FIELD

The present invention relates to a diaphragm pump with a diaphragm rupture signalling device, which is formed by a diaphragm arranged between the drive unit and the delivery unit of the diaphragm pump, which has a sensor area in which a diaphragm rupture is converted into a diaphragm rupture signalling signal. Furthermore, the present invention relates to a diaphragm for the diaphragm pump according to the invention, as well as to a method for repairing a diaphragm pump in which a diaphragm according to the invention is broken.

BACKGROUND

Diaphragm pumps convey liquids by means of the movement of a diaphragm. In this process, a stroke movement of an operating area of the diaphragm is transferred to the liquid to be conveyed in accordance with the stroke volume resulting from this. In the case of diaphragm pumps, a distinction is made between mechanically actuated and hydraulically actuated diaphragms.

In the case of hydraulically actuated diaphragms, the movement of a piston is transmitted to the diaphragm via a working fluid, whereby alternating compression and intake movements are performed (compression stroke and intake stroke). In the case of mechanically actuated diaphragms, the operating area of the diaphragm is moved back and forth preferably perpendicular to the diaphragm surface by a drive means arranged in the pump's drive unit.

Unlike hydraulically actuated diaphragms, the diaphragm is not subjected to a full-surface but rather a more central circular load, which can more easily lead to diaphragm rupture, especially at higher pressures.

If the diaphragm ruptures, for example due to wear, this can lead to a change in the stroke volume and thus also to a change in the pump output per stroke. This is particularly critical for dosing pumps, as it can lead to immediate deviations between the expected pump volume and the actual pump volume.

In addition, there is a possibility that the liquid to be pumped will enter the pump through the defective diaphragm. This is particularly critical for toxic, corrosive or explosive liquids, for example, as the liquid to be pumped can then escape from the pump.

There is therefore a need for systems that can either inhibit the diaphragm of diaphragm pumps from rupturing or that can immediately indicate a rupture so that the operator of the pump is aware of it and can rectify the defect.

STATE OF THE ART

A two-layer safety diaphragm for a diaphragm pump is known from EP 1 384 891 B1, in which, in the event of a diaphragm rupture, liquid can penetrate between the two diaphragm layers and cause an increase in pressure there. A sensor area is provided in the diaphragm layer facing the delivery unit. This sensor area is designed so that the distance between the diaphragm layer facing the delivery unit and the diaphragm layer facing the drive unit increases more than in all other areas of the diaphragm when the pressure increases.

In some embodiments of the safety diaphragm described in EP 1 384 891 B1, the diaphragm layer on the side facing the delivery unit is formed with a smaller material thickness in the sensor area than in the other sections of the diaphragm. In other embodiments, the material of this diaphragm layer has a higher elasticity here.

The sensor area of the safety diaphragm described in EP 1 384 891 B1 consists of a small circular field located in the area where the diaphragm is clamped between the drive unit and the delivery unit. An indicator element arranged in the delivery unit is aligned with this circular field. This element mechanically detects the expansion of the diaphragm in the direction of the delivery unit and transmits it in the form of a signal to a signal indicating element, whereby the diaphragm rupture is visually indicated on the outside of the delivery unit.

When the safety diaphragm described in EP 1 384 891 B1 is inserted for the first time or when replacing a diaphragm that has ruptured, it must always be inserted in such a way that the sensor area is precisely aligned with the signal reporting element arranged in the delivery unit, otherwise no or at least no reliable rupture notification is guaranteed. Reliable rupture reporting also requires that the signal indicating element on the outside of the delivery unit is intact and always displays the rupture report signal in a clearly visible manner. In the diaphragm pump described in EP 1 384 891 B1, the signal indicating element is protruding on the delivery unit and therefore susceptible to mechanical damage.

OBJECT OF THE INVENTION

In view of this, the invention is aimed at providing a diaphragm rupture signalling device for diaphragm pumps that ensures—in comparison to the prior art—a more functionally reliable rupture signalling than conventional diaphragm pumps.

DETAILED DESCRIPTION OF THE INVENTION

According to the present invention there is disclosed a diaphragm pump with a diaphragm rupture signalling device that has a diaphragm, a drive unit and a delivery unit, with the diaphragm being arranged between the drive unit and the delivery unit, with the drive unit having a drive means that can be moved back and forth on an axis of movement and the delivery unit has a delivery chamber for receiving a liquid to be pumped, wherein the diaphragm is movable by the drive means so that the liquid in the delivery chamber is moved, wherein

- the diaphragm has at least a first diaphragm layer and a second diaphragm layer,
- the at least first and second diaphragm layers have a substantially circular periphery and are in flat contact with one another,
- the diaphragm has a clamping area running around the entire circumference at the outer end of the circular perimeter for clamping the diaphragm between the drive unit and the delivery unit and an operating area adjoining in the direction of the centre point of the circular perimeter, a sensor region is provided in a section of the clamping region, in which sensor region at least one of the diaphragm layers is designed such that, when the pressure between this diaphragm layer and the diaphragm layer adjacent thereto increases, it moves—with the distance between the diaphragm layers increasing—further away from the adjacent diaphragm layer in the section of the sensor area than in the other sections of the diaphragm, and wherein a signal reporting element is arranged at the sensor region of the diaphragm, which converts an increase in the distance between the diaphragm layers in the section of the sensor region into a diaphragm rupture signalling signal and transmits it.

According to a first aspect of the present invention, a diaphragm pump is disclosed that has a diaphragm rupture signalling device of the aforementioned type, wherein the sensor area extends over the full extent of a circular path, which is essentially concentric with the circular periphery of the diaphragm.

Due to the sensor area extending completely over a circular path, which is concentric with the circular circumference of the diaphragm, this results in a continuous ring-shaped sensor area, which does not have to be precisely aligned with the signal reporting element arranged in the delivery unit when the diaphragm is inserted into the diaphragm pump. This eliminates the risk of faults in rupture detection caused by diaphragms that are not manufactured and aligned precisely enough.

In the context of the present invention, the term 'essentially concentric' comprises not only absolutely concentric arrangements but also designs with minimal deviations in the range of <2.0 mm, as may occur for manufacturing reasons, for example.

According to a second aspect of the present invention, a diaphragm pump is disclosed that has a diaphragm rupture signalling device of the aforementioned type, wherein the diaphragm is arranged between the drive unit and the delivery unit in such a way that the first diaphragm layer faces in the direction of the delivery unit and the second diaphragm layer faces in the direction of the drive unit, wherein the sensor area provided in a section of the clamping area is designed so that, when the pressure between the diaphragm layers increases, the second diaphragm layer moves away more easily from the adjacent diaphragm layer, increasing the distance between the diaphragm layers, than in the other sections of the diaphragm, as a result of which the distance between the diaphragm layers increases in the section of the sensor area in the direction of the drive unit.

Due to the fact that the second diaphragm layer points in the direction of the drive unit and is designed in such a way that it expands in the direction of the drive unit when the pressure between the diaphragm layers increases, the signal indicating element can be arranged in the area of the drive unit and is thus not located on the outside of the delivery unit, which is susceptible to mechanical damage, as is typically the case with conventional diaphragm pumps.

Both the first and second aspects of the invention described above provide a diaphragm rupture signalling device for diaphragm pumps that ensures more reliable rupture signalling compared to the prior art. The two aspects of the invention represent alternative technical solutions to the problem underlying the invention, which can be implemented either separately or in a complementary manner. The fact that only one of the two aspects is expressed in the main claims of the appended patent claims, while the other aspect is only expressed in the subsequent sub-claims, is purely formal and not technically motivated.

For example, the technical solution according to the first aspect of the invention, whereby the sensor area extends completely around a circular path that is concentric with the circular perimeter of the diaphragm, does not necessarily require that the second diaphragm layer, which faces the drive unit, be designed so that it can be easily moved in the direction of the drive unit when the pressure between the diaphragm layers in the sensor area increases. Instead, in the technical solution according to the first aspect of the invention, the first diaphragm layer, which points in the direction of the delivery unit, can also be designed in such a way that it can be easily moved in the direction of the delivery unit when the pressure between the diaphragm layers in the sensor area increases, as described in EP 1 384 891 B1.

On the other hand, the technical solution according to the second aspect of the invention, according to which the second diaphragm layer, which points in the direction of the drive unit, is designed in such a way that it can be easily moved in the direction of the drive unit when the pressure between the diaphragm layers in the sensor area increases, does not necessarily require that the sensor area extends completely over a circular path that runs concentrically with the circular circumference of the diaphragm. Instead, in the technical solution according to the second aspect of the invention, the sensor area can also consist of a small circular field, as described in EP 1 384 891 B1.

Only in certain embodiments the advantages of the technical solution according to the first aspect of the invention are combined with the advantages of the technical solution according to the second aspect of the invention, so that in these embodiments the sensor area extends entirely over a circular path being concentric with the circular circumference of the diaphragm, wherein the second diaphragm layer, which faces the drive unit, is formed in the sensor area so that it can be easily moved in the direction of the drive unit when the pressure between the diaphragm layers increases.

SPECIFIC EMBODIMENTS

The diaphragm pump according to the invention can either be a pure feed pump or a metering pump that delivers a precisely defined volume per stroke. Preferably, in the case of the diaphragm pump described here, it is a metering pump. In this case, the delivery chamber fulfils the function of a metering chamber for the precise delivery of defined volumes per stroke.

The present invention comprises both diaphragm pumps with hydraulically actuated diaphragms and diaphragm pumps with mechanically actuated diaphragms. In cases where the diaphragm is displaced hydraulically, the drive means located in the drive unit is a piston, the reciprocating motion of which causes the working fluid located between the piston and the diaphragm to exert different pressures on the diaphragm, causing it to reciprocate accordingly. In the mechanically actuated diaphragm configurations, the actuator is fixedly attached to the central region of the diaphragm so that the reciprocating motion of the actuator is directly imparted to the diaphragm.

In the embodiments in which the sensor area extends completely over a circular path that is concentric with the circular perimeter of the diaphragm, the sensor area forms an annular area that either borders the outer end of the circular perimeter of the diaphragm or is at a distance from it. In certain embodiments, the distance of the outer edge of the annular sensor area to the outer end of the circular circumference of the diaphragm is at least 1 mm or more, at least 3 mm or more or even at least 5 mm or more, throughout.

The ring-shaped sensor area can also be directly adjacent to the operating area. However, the inner edge of the ring-shaped sensor area is preferably at a distance of at least 1 mm, at least 3 mm or even at least 5 mm from the operating area throughout.

The width of the sensor area, i.e. the distance between the inner and outer edges of the ring-shaped sensor area, can be up to 2.5 cm in certain embodiments. In special embodiments, the minimum width is at least 0.3 cm or at least 0.5 cm and the maximum width is up to 2.0 cm, up to 1.5 cm or only up to 1.0 cm.

According to the invention, the sensor area is designed so that, in the event of a diaphragm rupture leading to an increase in pressure between the diaphragm layers, the distance between the diaphragm layers increases. This increase in distance is mechanically detected by the signal reporting element and converted into a diaphragm rupture signalling signal and forwarded. For this purpose, in the diaphragm according to the invention, at least one of the diaphragm layers is designed so that it can be more easily deformed when the pressure between the diaphragm layers in the sensor area increases and is thus moved further away from the adjacent diaphragm layer than in the other areas of the diaphragm.

In certain embodiments of the invention, the greater ease of deformation of one diaphragm layer and the greater increase in the distance between the diaphragm layers in the sensor area is caused by the fact that at least one of the diaphragm layers in this area is designed with a lower layer thickness, either throughout or in sections, than in all the other areas. In addition or as an alternative, in some embodiments this is achieved by the diaphragm in the sensor area being made entirely or at least in sections of a different material that is more easily deformable than all the other diaphragm sections.

In certain embodiments, the first and second diaphragm layers in the sensor area are designed such that one of the two diaphragm layers has a recess extending in the direction of the other of the two diaphragm layers over substantially the entire width of the sensor area and the other of the two diaphragm layers has an has an indentation that extends essentially across the entire width of the sensor area, wherein the recess in one diaphragm layer and the indentation in the other diaphragm layer are located opposite each other and the two diaphragm layers are not connected to each other essentially across the entire sensor area.

Outside the sensor area, the diaphragm layers can be connected to one another at least in sections for stability purposes. However, it must be ensured that in the event of a diaphragm rupture in the operating area, liquid penetrating between the diaphragm layers can penetrate as far as the sensor area so that the diaphragm rupture event can be transmitted to the signal reporting element.

The sensor area is preferably designed so that an increase of 2 bar or more in the pressure between the diaphragm layers increases the distance between the diaphragm layers by at least 0.5 mm, preferably by at least 1 mm and more preferably by at least 2 mm. The increase in the distance between the diaphragm layers in the aforementioned areas occurs particularly advantageously when the pressure is increased by just 1 bar, and even more preferably when the pressure is increased by just 0.5 bar.

In particular embodiments of the invention, the diaphragm layers are designed such that the distance between the diaphragm layers returns to the original distance after a diaphragm rupture event by at least 40%, preferably at least 60% and particularly preferably at least 80%, when the excess pressure between the diaphragm layers caused by the diaphragm rupture is no longer present.

All plastic and polymer materials commonly used for diaphragm pump diaphragms can be considered as materials for the diaphragm layers, such as ethylene-propylene-diene rubber (EPDM), polytetrafluoroethylene (PTFE), nitrile-butadiene rubber (NBR) or polyethylene (PE). Preferably, the material of the first diaphragm layer is EPDM. Preferably, the material of the second diaphragm layer is PTFE, which has the advantage that liquid penetrating between the diaphragm layers cannot penetrate through the PTFE layer to the outside, thus protecting sensitive components of the diaphragm pump and the user.

In certain embodiments of the invention, a third diaphragm layer is provided in addition to the first and second diaphragm layers on the side of the first diaphragm layer that is opposite the second diaphragm layer. Preferably, the material of this third diaphragm layer consists of polytetrafluoroethylene (PTFE) or polyethylene (PE).

In certain embodiments, the diaphragm is arranged between the drive unit and the delivery unit in such a way that the first diaphragm layer faces the delivery unit and the second diaphragm layer faces the drive unit. Depending on which of the two diaphragm layers in the sensor area is designed such that, in the event of a diaphragm rupture, the distance between this diaphragm layer and the other diaphragm layer increases due to the increase in pressure between the diaphragm layers, the signal reporting element is provided either on the drive unit or on the delivery unit of the diaphragm pump. In conventional diaphragm pumps, the signal reporting element is typically arranged in the delivery unit, so that the indication of a diaphragm rupture is usually provided on the outside of the delivery unit. In contrast to this, in the diaphragm pump according to the invention, the signal reporting element is preferably arranged on the drive unit, since a mechanically better protected arrangement is possible here, whereby there is a lower risk of accidental damage to the signal reporting element.

In certain embodiments of the invention, in addition to the signal reporting element, a signal indicating element is also provided, which receives a diaphragm rupture signalling signal forwarded by the signal reporting element and displays it visually on the outside of the drive unit or the delivery unit. The advantage of these embodiments is that the movement of one of the diaphragm layers of the sensor area, which is typically mechanically transmitted on the same axis on which the diaphragms in the sensor area move away from each other, by transmitting the signal to an additional signal indicating element, the location of the indication of the diaphragm rupture signalling signal does not necessarily have to lie on the same axis of movement of the signal indicating element.

Accordingly, certain embodiments of the invention are designed such that a diaphragm rupture signalling signal forwarded by the signal reporting element is a movement of the signal reporting element along a first axis, which causes a movement of the signal indicating element along a second axis, the first axis and the second axis forming an angle that is greater than 0°. Preferably, the angle at which the second axis of movement deviates from the first axis of movement is at least 30°, at least 45°, at least 60° or at least 75°. In a particular embodiment, the angle between the first and second axes is 90±5° or substantially 90°.

In some embodiments, there is a direct force transfer from the signal reporting element to the signal indicating element.

In other embodiments, movement of the signal reporting element due to a membrane rupture activates a trigger mechanism, which in turn causes a movement of the signal indicating element that is not proportional to the movement force of the signal reporting element.

In a particular embodiment with a trigger mechanism, this is a spring-loaded bolt that fixes the signal indicating element when the diaphragm is intact and releases the signal indicating element when the signal reporting element transmits a diaphragm rupture signalling signal. The correspondingly released signal indicating element can then be moved, for example, by gravity alone. In addition or as an alternative, the signal indicating element can also be moved by a spring or the like.

In certain embodiments, the triggering element and/or the signal indicating element are prestressed by a compression spring with a force of ≥0.1 newton, preferably ≥0.5 newton and particularly preferably ≥1 newton.

The signal indicating element can indicate the diaphragm rupture event in various ways, whether visually, acoustically or in the form of an electrical signal. In certain embodiments, the signal indicating element is a signalling body with a diaphragm rupture indicating portion, wherein at least the diaphragm rupture indicating portion is arranged in the drive unit or in the delivery unit so that it is not visible from the outside when the diaphragm is intact. Only in the event of a diaphragm rupture the diaphragm rupture signalling signal, which is transmitted by the signal reporting element, is caused to move the signal indicating element in such a way that the diaphragm rupture indicating portion becomes visible from the outside. In the case of an intact diaphragm, the signal reporting element can be hidden in a protected manner in the drive unit or the delivery unit in these embodiments. It is therefore only visible on the outside of the drive unit or delivery unit in the event of a diaphragm rupture.

In some embodiments of the invention, the diaphragm rupture indicating portion has no special features. The mere fact that the diaphragm rupture indicating portion becomes visible from the outside is sufficient here as a diaphragm rupture indicator. However, in some embodiments, an additional signalling or information function is provided in the diaphragm rupture indicating portion. For example, the diaphragm rupture indicating portion may have a particularly eye-catching colour design or may contain an inscription, a barcode or a QR code.

An inscription in the diaphragm rupture indicating portion can, for example, indicate the order or type number of the diaphragm affected by the diaphragm rupture. A barcode or QR code can be scanned or read for ordering purposes. The information provided in this way can also comprise, for example, instructions for dismantling or reordering a replacement diaphragm.

In addition to or as an alternative to the visual display in the form of the diaphragm rupture indicating portion, in certain embodiments of the invention the signal indicating element is designed such that it can trigger an electrical signal. For example, a magnet can be provided in the signal indicating element, which triggers a reed contact arranged in the pump. The signal indicating element can also trigger a light barrier. For this purpose, a continuous recess may be provided in the indicating element in certain embodiments. In other embodiments, the electrical signal is generated piezoelectrically, e.g. by the application of the spring-loaded bolt. The electrical signal can also be generated capacitively or inductively, e.g. by detecting a continuous recess or a metal insert in the signal indicating element. In addition, the signal indicating element can also have a metallic insert that is short-circuited.

In the embodiments in which a signal indicating element is provided, it is preferable that, while the pump is running, it cannot be displaced out of the signal indicating position caused by the diaphragm rupture and back into the starting position as long as a diaphragm rupture is still present.

In the embodiments with a signal indicating element, said element can be removed manually and without the use of tools in the state in which the diaphragm rupture indicating portion is visible from the outside in the event of a diaphragm rupture.

In addition to the diaphragm pump according to the invention with the diaphragm rupture signalling device described above, the present invention also relates to a diaphragm for such a diaphragm pump, said diaphragm having at least a first diaphragm layer and a second diaphragm layer, wherein the at least first and second diaphragm layers have a substantially circular periphery and lying flat against one another, the diaphragm having at the outer end of the circular periphery has a clamping region extending around the full periphery for clamping the diaphragm in a diaphragm pump, and a sensor region is provided in a section of the clamping region of the diaphragm, in which sensor region at least one of the diaphragm layers is designed such that, when the pressure between this diaphragm layer and the diaphragm layer adjacent thereto increases, it moves—with the distance between the diaphragm layers increasing—away from the adjacent diaphragm layer in the section of the sensor area, more than in the other sections of the diaphragm, wherein the diaphragm is characterised in particular by the fact that the sensor area extends completely over a circular path that runs concentrically with the outer end of the circular circumference of the diaphragm.

In addition, the diaphragm according to the invention can also have at least one of the other features described above.

Furthermore, the present invention also relates to a method for repairing a diaphragm pump with a diaphragm rupture signalling device according to the invention, in which the diaphragm has a rupture, whereby the ruptured diaphragm is replaced by a diaphragm according to the invention as mentioned above.

For the purposes of the original disclosure, it should be noted that all features, as they can be derived by a person skilled in the art from the present description, the accompanying drawings and the claims, even if they have been specifically described only in connection with certain further features, can be combined both individually and in any combination with other features or groups of features disclosed herein, unless this has been expressly excluded or technical circumstances make such combinations impossible or pointless. The comprehensive, explicit presentation of all conceivable combinations of features is only omitted here for the sake of brevity and readability of the description.

Furthermore, it should be noted that it is self-evident to the person skilled in the art that the following examples are intended only to exemplify the possible embodiments of the present invention as exemplified. The skilled person will therefore readily understand that, in addition, all other embodiments having the features or combinations of features mentioned in the claims according to the invention also lie within the scope of protection of the invention. The comprehensive, explicit presentation of all conceivable embodiments is only omitted here for the sake of brevity and readability of the description.

The following figures show examples of embodiments of the invention.

Figure 1:
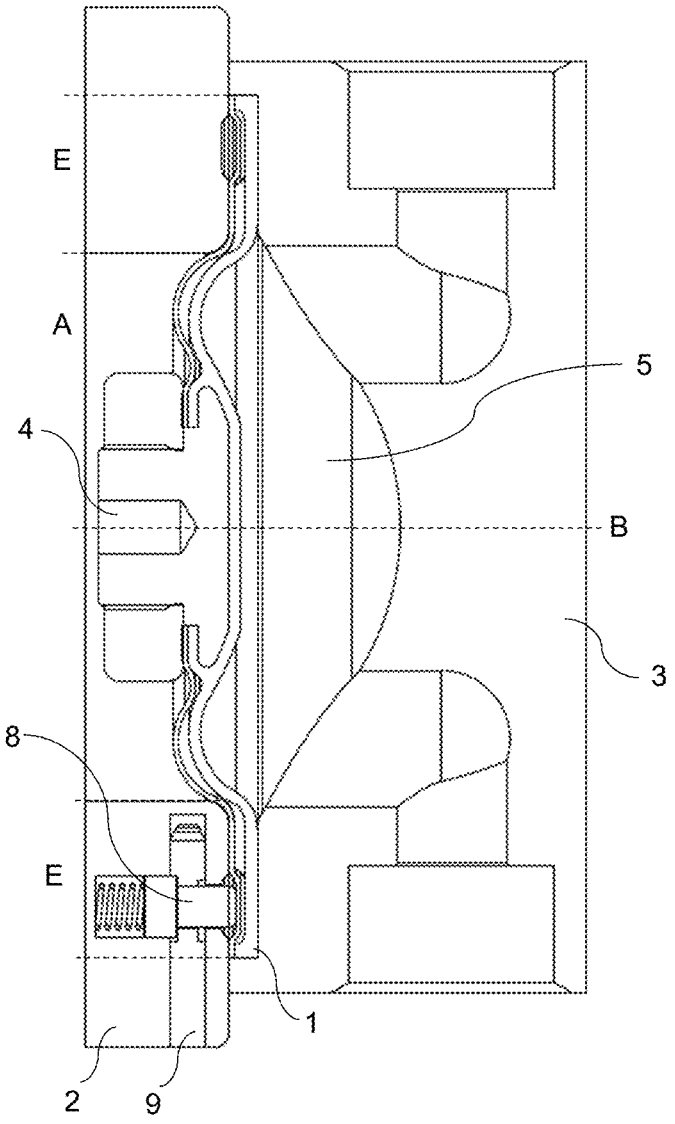
FIG. 1 is a cross-section through the pump head of a diaphragm pump according to the invention, in which the diaphragm is intact and has not triggered the diaphragm rupture signalling device.

The cross-sectional view of the pump head of a diaphragm pump with a diaphragm rupture signalling device according to the invention, as shown in FIG. 1, shows that the diaphragm 1 is clamped between the end of the drive unit 2 and the delivery unit 3 shown here. In particular, the clamping area E of the diaphragm 1 is fixed between the drive unit 2 and the delivery unit 3. In the central area of the diaphragm 1, it is firmly connected to the drive means 4 arranged in the drive unit 2. When the drive means 4 is moved back and forth on the movement axis B, the liquid located in the delivery chamber 5 of the delivery unit 3 is moved according to the stroke volume of the drive unit 4 and by the diaphragm 1 moved accordingly in the operating area A. The signal reporting element 8 and the signal indicating element 9 are located at the lower end of the drive unit 2.

Figure 2:
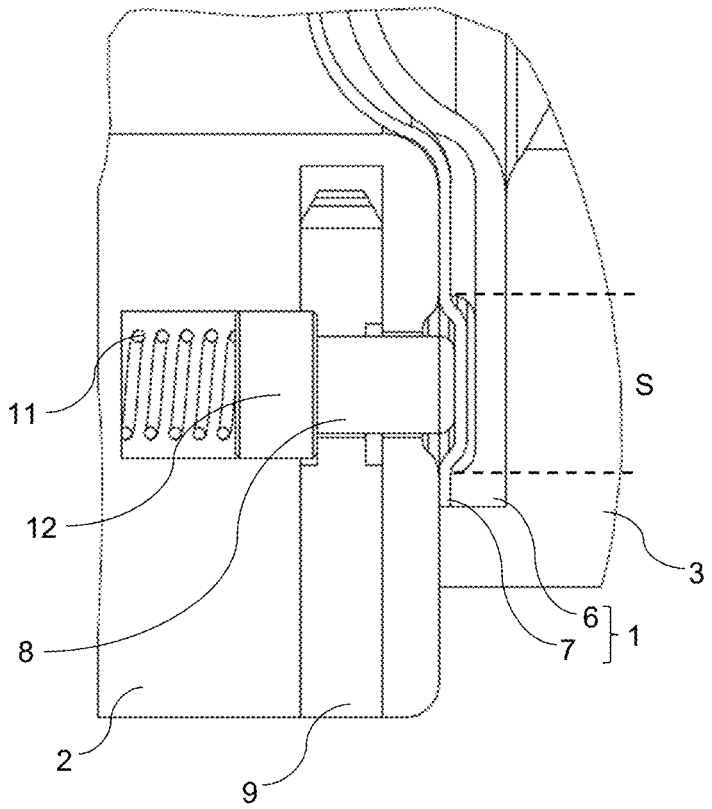
FIG. 2 is a detailed view of the diaphragm rupture signalling device of the diaphragm pump according to the invention shown in FIG. 1, in which the diaphragm is intact and has not triggered the diaphragm rupture signalling device.

FIG. 2 shows a detailed view of the diaphragm pump according to the invention shown in FIG. 1, whereby in the state that is shown here the diaphragm 1 is intact, so that the diaphragm rupture signalling device does not indicate a diaphragm rupture signalling signal. The sensor area S and the two-layer structure of the diaphragm 1, consisting of a first diaphragm 6 and a second diaphragm 7, which are in full-surface contact with one another, can be clearly seen in this detailed view. In the embodiment shown here, the first diaphragm layer 6 points in the direction of the delivery unit 3, while the second diaphragm layer 7 points in the direction of the drive unit 2. In the sensor area S, the diaphragm 1 is designed such that the first diaphragm 6 has a recess over essentially the entire width of the sensor area S, and the second diaphragm layer 7 has a corresponding embossing over essentially the entire width of the sensor area S. The recess on the one side and the embossment on the other side are thus located opposite one another over essentially the entire sensor area and are not connected to one another in this area. In the sensor area S and in the direction of the drive unit 2, there is located on the second diaphragm layer 7 of the diaphragm 1 a signal reporting element 8 in the form of a pin, which can be moved back and forth in a direction perpendicular to the sensor area S. In the direction of the drive unit 2, a locking portion 12 is provided on the signal reporting element 8, which is biased by the spring 11 and, in the state shown here, holds the signal indicating element 9 in a position in which the signal indicating element 9 is completely arranged in the housing of the drive unit 2.

Figure 3:
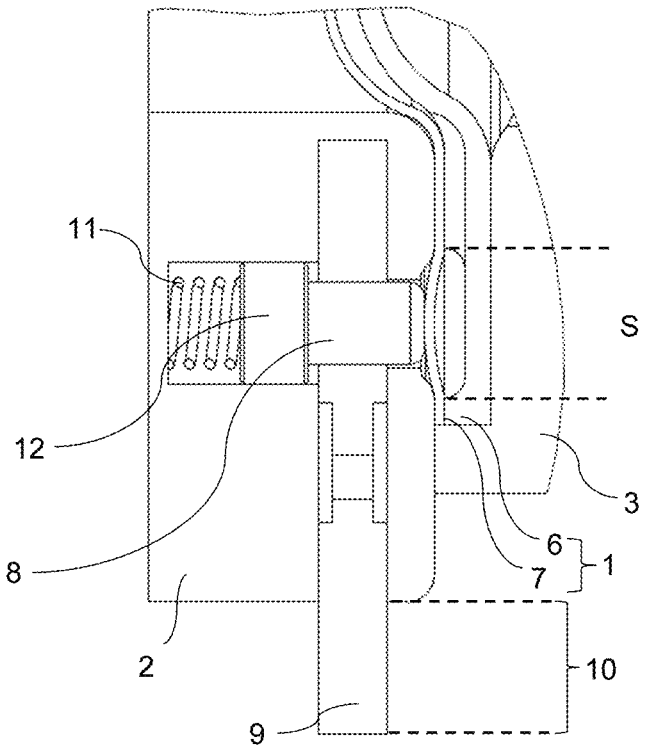
FIG. 3 is a detailed view of the diaphragm pump shown in FIG. 1, in which the diaphragm is defective and the diaphragm rupture signalling device has signalled a diaphragm rupture.

FIG. 3 shows the same detailed view of the inventive diaphragm pump as in FIG. 2, wherein here the state is shown in which the diaphragm rupture signalling device has been triggered due to a diaphragm rupture. As a result of the increase in pressure between the diaphragm layers 6 and 7 that occurs when the diaphragm ruptures, the embossing in the second diaphragm layer 7 bulges in the sensor area S, causing it to move away from the first diaphragm layer 6 and the signal reporting element 8 adjacent to the second diaphragm layer 7 to move in the direction of the drive unit 2, whereby in turn the locking portion 12 is also pressed against the force of the spring 11 in the direction of the drive unit 2, so that it releases the signal indicating element 9, which causes it to project out of the housing of the drive unit 2 due to gravity such that the diaphragm rupture indicating portion 10 becomes visible from the outside.

Figure 4:
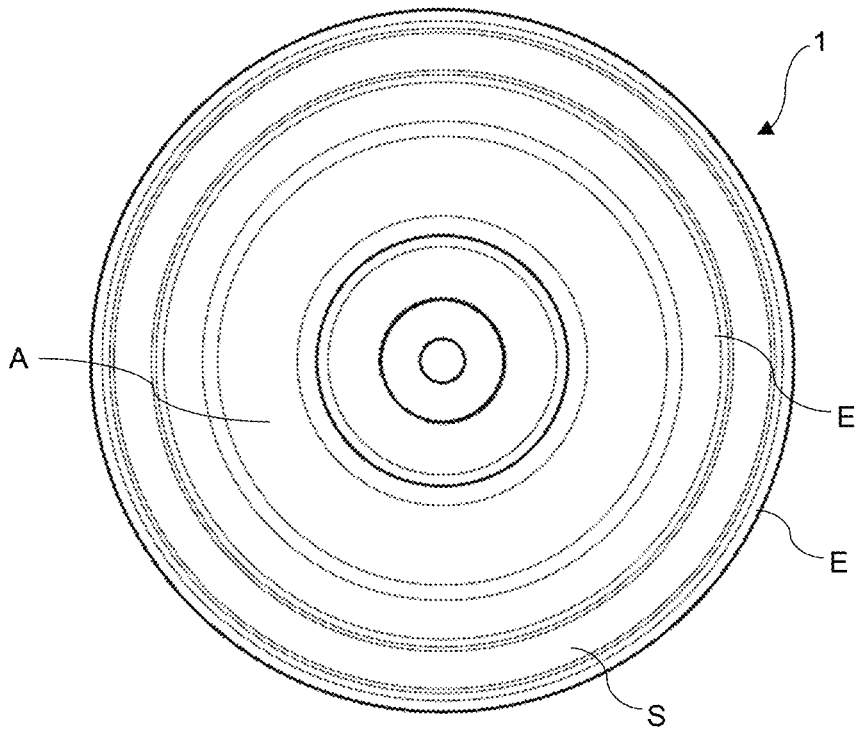
FIG. 4 is a highly schematic top view of a diaphragm according to the invention.

FIG. 4 shows a schematic top view of a diaphragm according to the invention, in which the central operating area A is delimited from the clamping area E. In this highly schematically illustrated embodiment shown here, the ring-shaped sensor area S is located within the clamping area E both at a distance from the operating area A and from the outer edge of the diaphragm 1.

LIST OF REFERENCE SIGNS

1 diaphragm
2 drive unit
3 delivery unit
4 drive means
5 delivery chamber
6 first diaphragm layer
7 second diaphragm layer
8 signal reporting element
9 signal indicating element
10 diaphragm rupture indicating portion
11 spring
12 locking portion
A operating area
B axis
E clamping area
S sensor area

The invention claimed is:

1. A diaphragm pump with a diaphragm rupture signalling device, the diaphragm pump having a diaphragm (1), a drive unit (2) and a delivery unit (3), the diaphragm (1) being arranged between the drive unit (2) and the delivery unit (3), the drive unit (2) having a drive means (4) that can be moved back and forth on a movement axis (B) and the delivery unit (3) has a delivery chamber (5) for receiving a liquid to be pumped, wherein the diaphragm (1) is movable by the drive means (4) so that liquid in the delivery chamber (5) is moved, wherein the diaphragm (1) has at least a first diaphragm layer (6) and a second diaphragm layer (7), the at least first and second diaphragm layers (6, 7) have a substantially circular periphery and a center point of the circular periphery and are in flat contact with one another, the diaphragm (1) has a clamping area (E) running around the entire circumference of the substantially circular periphery for clamping the diaphragm (1) between the drive unit (2) and the delivery unit (3) and an operating area (A) adjoining in the direction of the center point of the circular periphery, a sensor region (S) is provided in a sensor region section of the clamping area (E), in which sensor region at least one of the at least one first and at least one second diaphragm layers (6, 7) is designed such that, when the pressure between the at least one first diaphragm layer (6, 7) and the at least one second diaphragm layer (7, 6) adjacent thereto increases, the at least one first or the at least one second diaphragm layer (6, 7) moves further away from the adjacent at least one first or at least one second diaphragm layer (7, 6) in the sensor region (S) than in all other sections of the diaphragm (1), and wherein a signal reporting element (8) is arranged at the sensor region (S) of the diaphragm (1), which converts an increase in the distance between the diaphragm layers (6, 7) in the section of the sensor region (S) into a diaphragm rupture signalling signal and transmits it, characterised in that the sensor region (S) extends over the full extent of a circular path, which is substantially concentric with the circular periphery of the diaphragm (1).

2. The diaphragm pump with a diaphragm rupture signalling device according to claim 1, characterised in that the sensor region (S) extends at a radially outer peripheral region of the diaphragm (1).

3. The diaphragm pump with a diaphragm rupture signalling device according to claim 1, characterised in that the sensor region (S) extends at a distance from the operating area (A).

4. The diaphragm pump with a diaphragm rupture signalling device according to claim 1, characterised in that the first and second diaphragm layers (6, 7) are designed such that one of the two diaphragm layers (6, 7) in the sensor region (S) has, in the direction of the other of the two diaphragm layers (7, 6) a recess extending substantially over the entire width of the sensor region (S), and the other of the two diaphragm layers (7, 6) in the sensor region (S) has, in the direction of the first diaphragm layer (6, 7) an embossment extending substantially over the entire width of the sensor region (S).

5. The diaphragm pump with a diaphragm rupture signalling device according to claim 1, characterised in that the diaphragm (1) is arranged between the drive unit (2) and the delivery unit (3) in such a way that the first diaphragm layer (6) faces in the direction of the delivery unit (3) and the second diaphragm layer (7) faces in the direction of the drive unit (2).

6. The diaphragm pump with a diaphragm rupture signalling device according to claim 1, characterised in that the signal reporting element (8) is arranged on the drive unit (2) or in the drive unit (2).

7. The diaphragm pump with a diaphragm rupture signalling device according to claim 1, characterised in that a signal indicating element (9) is provided on the drive unit (2) or on the delivery unit (3), which receives a diaphragm rupture signalling signal forwarded by the signal reporting element (8) and displays the diaphragm rupture signalling signal visually on the outside of the drive unit (2) or of the delivery unit (3).

8. The diaphragm pump with a diaphragm rupture signalling device according to claim 7, characterised in that the diaphragm rupture signalling signal forwarded by the signal reporting element (8) is a movement of the signal reporting element (8) along a first axis, which causes a movement of the signal indicating element (9) along a second axis, wherein the first axis and the second axis form an angle of >0°.

9. The diaphragm pump with a diaphragm rupture signalling device according to claim 7, characterised in that the diaphragm rupture signalling signal transmitted by the signal reporting element (8) is a movement of the signal reporting element (8) that activates a trigger mechanism, causing a movement of the signal indicating element (9).

10. The diaphragm pump with a diaphragm rupture signalling device according to claim 7, characterised in that the signal indicating element (9) triggers an electrical signal or has a diaphragm rupture indicating portion (10), wherein the diaphragm rupture indicating portion (10) is arranged in the drive unit (2) or in the delivery unit (3) so as not to be visible from the outside when the diaphragm (1) is arranged in the drive unit (2) or in the delivery unit (3) in such a way that it is not visible from the outside, and wherein the diaphragm rupture signalling signal forwarded by the signal reporting element (8) causes the signal indicating element (9) to move in such a way that the diaphragm rupture indicating portion (10) becomes visible from the outside.

11. The diaphragm pump with a diaphragm rupture signalling device according to claim 10, characterised in that the diaphragm rupture indicating portion (10) has an inscription, a bar code, or a QR code.

12. The diaphragm pump with a diaphragm rupture signalling device according to claim 10, characterised in that the signal indicating element (9) can be manually removed without the use of tools in the state in which the diaphragm rupture indicating portion (10) is visible from the outside.

13. The diaphragm pump with a diaphragm rupture signalling device according to claim 10, characterised in that, in the state in which the diaphragm rupture indicating portion (10) is visible from the outside, it is not possible, when the pump is running, for the signal indicating element (9) to be displaced back out of a signal indicating position caused by the diaphragm rupture and back into a starting position, as long as the diaphragm rupture is still present.

14. A diaphragm (1) for a diaphragm pump, wherein the diaphragm (1) has at least a first diaphragm layer (6) and a second diaphragm layer (7), the at least first and second diaphragm layers (6, 7) have a substantially circular periphery and are connected to one another in a manner such that they lie flat against one another, the diaphragm (1) has a fully peripheral clamping area (E) running around the entire circumference of the substantially circular periphery for clamping the diaphragm (1) in a diaphragm pump, in a section of the clamping area (E) of the diaphragm, a sensor region (S) is provided, in which at least one of the at least one first and the at least one second diaphragm layers (6, 7) is designed in such a way that when the pressure between the at least one first diaphragm layer (6, 7) and the adjacent at least one second diaphragm layer (7, 6) is increased, the at least one first or the at least one second diaphragm layer (6, 7) moves further away from the adjacent at least one first or the at least one second diaphragm layer (7, 6) in the section of the sensor region (S) than in all other sections of the diaphragm (1), characterised in that the sensor region (S) extends over the full extent of a circular path, which runs substantially concentrically with the circumference of the substantially circular periphery of the diaphragm (1).

15. A method for repairing a diaphragm pump having a diaphragm rupture signalling device according to claim 1, wherein the diaphragm pump has an original diaphragm (1) having a rupture, characterised in that the original diaphragm (1) having a rupture is replaced by a replacement diaphragm, wherein the replacement diaphragm (1) has at least a first diaphragm layer (6) and a second diaphragm layer (7), the at least first and second diaphragm layers (6, 7) have a substantially circular periphery and are connected to one another in a manner such that they lie flat against one another, the replacement diaphragm (1) has a fully peripheral clamping area (E) running around the entire circumference of the substantially circular periphery for clamping the replacement diaphragm (1) in a diaphragm pump, in a section of the clamping area (E) of the diaphragm, a sensor region (S) is provided, in which at least one of the at least one first and the at least one second diaphragm layers (6, 7) is designed in such a way that when the pressure between the at least one first diaphragm layer (6, 7) and the adjacent at least one second diaphragm layer (7, 6) is increased, the at least one first or the at least one second diaphragm layer (6, 7) moves further away from the adjacent at least one first or at least one second diaphragm layer in the section of the sensor region (S) than in all other sections of the replacement diaphragm (1), characterised in that the sensor region (S) extends over the full extent of a circular path, which runs substantially concentrically with the circumference of the substantially circular periphery of the replacement diaphragm (1).

* * * * *